United States Patent [19]

Gerhard

[11] 4,214,535

[45] Jul. 29, 1980

[54] SWITCH FOR A SUSPENDED RAILWAY VEHICLE

[75] Inventor: Thomas Gerhard, Viersen, Fed. Rep. of Germany

[73] Assignee: Waggonfabrik Uerdingen A.G., Krefeld, Fed. Rep. of Germany

[21] Appl. No.: 946,448

[22] Filed: Sep. 25, 1978

[30] Foreign Application Priority Data

Sep. 27, 1977 [DE] Fed. Rep. of Germany ..... 2743316

[51] Int. Cl.[2] ..... E01B 25/26

[52] U.S. Cl. ..... 104/91; 104/130

[58] Field of Search ..... 104/96, 94, 91, 105, 104/108, 130, 247

[56] References Cited

U.S. PATENT DOCUMENTS 3,196,804 7/1965 Harrison ..... 104/96
3,946,974 3/1976 Stiefel et al. ..... 104/130

FOREIGN PATENT DOCUMENTS 2428830 1/1976 Fed. Rep. of Germany ..... 104/96
969222 9/1964 United Kingdom ..... 104/96
1371511 10/1974 United Kingdom ..... 104/130

*Primary Examiner*—John J. Love
*Assistant Examiner*—Ross Weaver
*Attorney, Agent, or Firm*—Michael J. Striker

[57] ABSTRACT

A switch for a suspended railway vehicle having two elastic wheels, comprises four rails forming three paths one of which branches off into two other paths. A gap is bounded between the four rails. When the vehicle runs over the switch from one to another path one of its wheels enters the gap and runs without support, and after passing the gap this wheel engages with a portion of one rail of the other path. A plurality of ramps are provided each arranged on a respective one of the above-mentioned portions and so that after passing the gap the one wheel is raised by the ramp to a contact surface of the rail of the other path. At the same time, each ramp includes a transitional portion merging into the rails with a transverse inclination which decreases proceeding in the direction along which the transitional portion merges into the respective rail.

8 Claims, 6 Drawing Figures

SWITCH FOR A SUSPENDED RAILWAY VEHICLE

BACKGROUND OF THE INVENTION

The present invention relates to a switch for a suspended railway vehicle having elastic noise-suppressing wheels.

Switches for suspended railway vehicles are widely used. Such switches include rails forming three paths one of which branches off into two other paths. The vehicle is provided with rollers arranged on its chassis and supported on the switch during running of the vehicle over the latter. A longitudinal slot is formed between each pair of rails, through which slot the suspension connecting the chassis of the vehicle with its cabin can downwardly extend. When the vehicle runs over the switch from one to another path, one of its wheels enters a gap which is formed between the rails and runs without support. After passing the gap, this wheel engages a portion of one rail of the other path, and the vehicle continues to run along the latter. Since one wheel of the vehicle runs without support, the other wheel is loaded with a doubled operational load. When the vehicle wheels are elastic so as to provide improved noise-suppressing action, the above-mentioned other wheel is correspondingly compressed under the action of the doubled load and thereby the unsupported wheel tends to lower to a level located below the contact surface of the rails. The magnitude of this lowering further increases in the case when the roller device provided on the vehicle for maintaining the same in stable condition on the switch, has significant play.

In order to raise the unsupported wheel lowered in the region of the gap, onto the contact surface of the next rail, a plurality of ramps are provided. Each ramp is arranged on the above-mentioned portions which the unsupported wheel of the vehicle engages after passing the gap. The ramps are arranged on an initial section of the switch or, in other words, on the rails of the branching off path and upstream of the gap, as considered in the direction in which the first path branches off into the second and third paths. The ramps are also arranged on a switch tip or, in other words, on the merging inner rails of the two merging paths and upstream of the gap, as considered in the direction in which the two paths merge into the first-mentioned path. The ramps provided on the switch tip are utilized for running in the branching off direction, either along the stright path or along the branching path. The ramps provided on the initial section of the switch are utilized for running in the opposite direction, that is in the merging direction. All ramps are inclined in the direction of elongation of the rails. Such a construction is disclosed, for instance, in the German patent No. 24 31 867 and the U.S. Pat. No. 3,946,974.

When the double-loaded wheel of the vehicle passes out of the inclined ramp located on the initial section of the switch, only a small section of the contact surface of the respective ramp located laterally of the inclination is available for supporting this wheel. This has the disadvantage that the above-mentioned already significantly loaded wheel is subjected to high contact pressure. As for the ramps which are arranged on the switch tip, there inclination can be also disadvantageous taking into consideration deflection of these ramps during running up of the unloaded wheel of the vehicle thereover, especially when the rails of the switch are not formed as shaped separate members.

SUMMARY OF THE INVENTION

Accordingly, it is an object of the present invention to provide a switch for a suspended railway vehicle having elastic wheels, which avoids the disadvantages of the prior art.

More particularly, it is an object of the present invention to provide a switch for a suspended railway vehicle having elastic wheels, which provide for lower loading on and improved movement of the wheels of the vehicle, as compared with prior-art switches.

In keeping with these objects and with others which will become apparent hereinafter, one feature of the present invention resides, briefly stated, in a switch in which ramps arranged on rails are inclined in the direction transverse to the direction of elongation and each includes a transitional portion merging into the respective rail with a transverse inclination which decreases in the direction along which the transitional portion merges into the respective rail.

In such a construction when the vehicle wheel which is in engagement with the rail and is loaded runs on the inclined ramp, a significantly wide supporting surface is provided for this wheel in the region of the ramp. At the same time, the matching of this wheel to the transitional portion of the ramp merging into the respective rail is performed gradually and continuously. The switch in accordance with the present invention provides for good running conditions, less wear and tear on the wheels, and a longer service life of the vehicle chassis.

In accordance with another feature of the present invention, each of the ramps which are arranged upstream of the switch gap, as considered in the branching off direction, includes two sections which are spaced from one another in the transverse direction and have differing transverse inclinations. One of the sections is located adjacent to the slot which is formed between two rails for inserting the suspension of the vehicle, whereas the other section is transversely spaced from the slot. The one section has a steeper inclination than the other section of the respective ramp. The above-mentioned sections may be connected with one another by a transitional section which is shaped as a circular arc.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
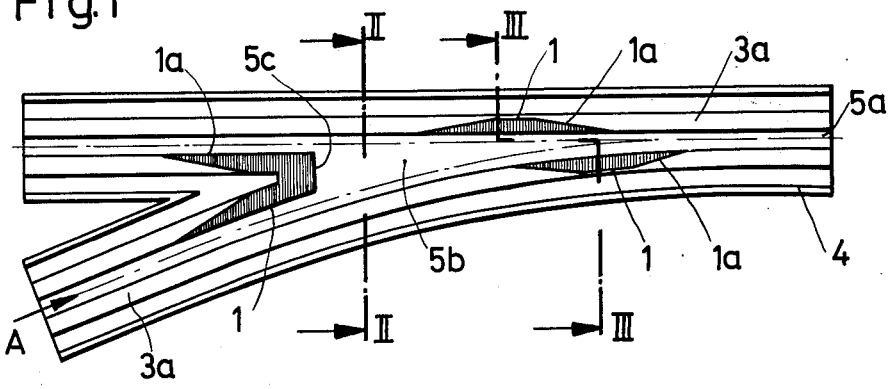
FIG. 1 is a schematic view of a switch for a suspended railway vehicle, in accordance with the present invention.

The drawing depicts a switch for a suspended railway vehicle having elastic wheels. The switch has a box-like cross section and comprises two side walls 4, two bottom flanges 5 bounding a central longitudinal slot 5*a* and a top flange which is not shown in the drawing. Each slot 5*a* opens into a gap 5*b* formed between rails of the switch and serves for passing through a suspension which connects a vehicle cabin for passengers or loads with a vehicle chassis 6. The switch has rails 3 provided for supporting wheels 6*a* of the chassis 6. The rails may be formed as projecting portions of one piece with the bottom flanges 5, or as shown in the drawing as separate shaped members 3*a* which are mounted on the bottom flanges 5, or as flush or recessed portions on the bottom flanges 5.

As can be seen in FIG. 1 of the drawing, two right rails together form one path, whereas two pairs of left rails form two further paths which branch off from the first-mentioned path. The direction from the first-mentioned path toward the further paths is the branching off direction, whereas the direction from the further paths to the first-mentioned path is the merging direction. The rails 3 or 3*a* are provided with ramps 1 which are arranged on an initial portion of the switch gap 5*b*, that is upstream of the gap 5*b* as considered in the branching off direction, and also on a switch tip 5*c*, that is on two merging inner rails of the left pairs upstream the switch gap 5*b*, as considered in the merging direction. The functions of the ramps 1 will be explained in detail further below.

When the vehicle runs in the region of the switch gap 5*b* from one to another path only one wheel thereof runs in engagement with a respective one of the rails, whereas the other wheel enters the gap 5*b* and runs without support. The first-mentioned wheel is compressed under the action of the doubled load, whereby the other wheel lowers and has to be raised after passing the gap onto a contact surface of a respective rail of the other path. When the vehicle runs in the merging direction which is identified by reference letter A in FIG. 1, the right wheel 6*a* runs in engagement with the right rail 3*a* of the switch as shown in FIG. 9. In this operating position tilting of the vehicle is prevented by a guiding device including rollers 6*b* arranged on the chassis 6 of the vehicle and guiding elements 4*a* arranged on the side walls 4 of the switch for supporting and guiding the rollers 6*b*.

Figure 2:
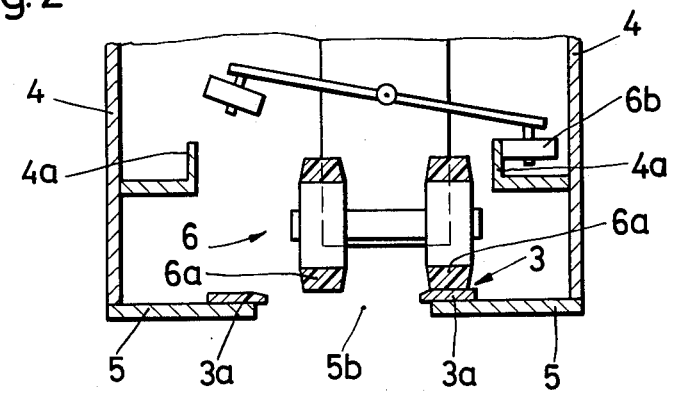
FIG. 2 is a view showing a section which is taken along the line II—II of FIG. 1 with a chassis of a vehicle suspended on the switch, on a larger scale.
Figure 3:
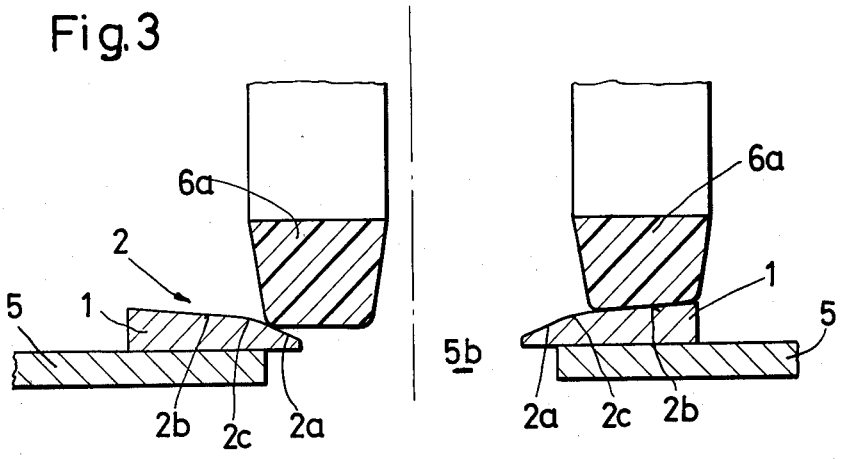
FIG. 3 is a view showing a section taken along the line III—III of FIG. 1 and also on an enlarged scale.
Figure 4:
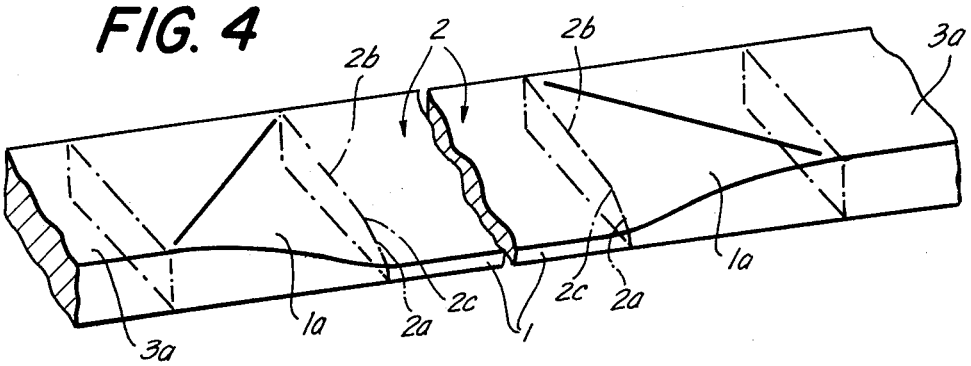
FIG. 4 is a perspective view showing a ramp arranged on an initial portion of the switch as to be seen in FIG. 1.

As mentioned above the vehicle wheel which runs unsupported and lowers under the action of compression of the supported wheel, for instance the left wheel in FIGS. 2 and 3, must be raised onto the contact surface of the rails, and more particularly onto the contact surface of the left rail. For this purpose,—as particularly shown in FIGS. 4, 5 and 6—each of the ramps are inclined in the direction transverse to the direction of elongation of the respective rails, as identified by reference numeral 2. Each ramp 1 includes at least one transitional portion 1*a* merging into the respective rail with a transverse inclination which decreases proceeding in the direction along which the transitional portion 1*a* merges into the respective rail.

Figure 5:
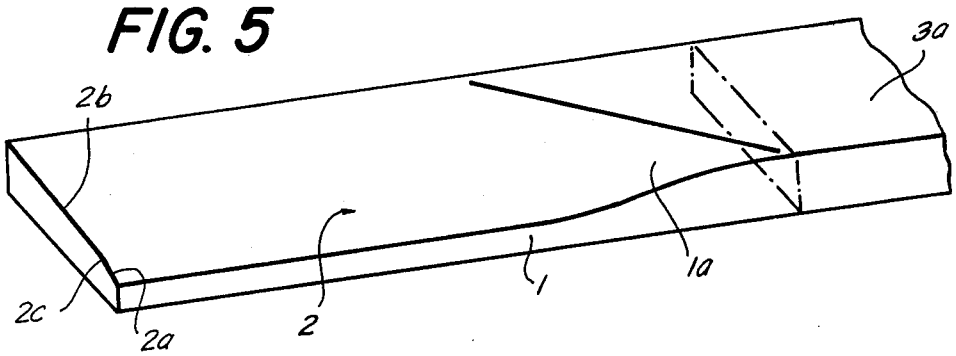
FIG. 5 is a perspective view showing a ramp arranged on a switch tip as to be seen in FIG. 1.
Figure 6:
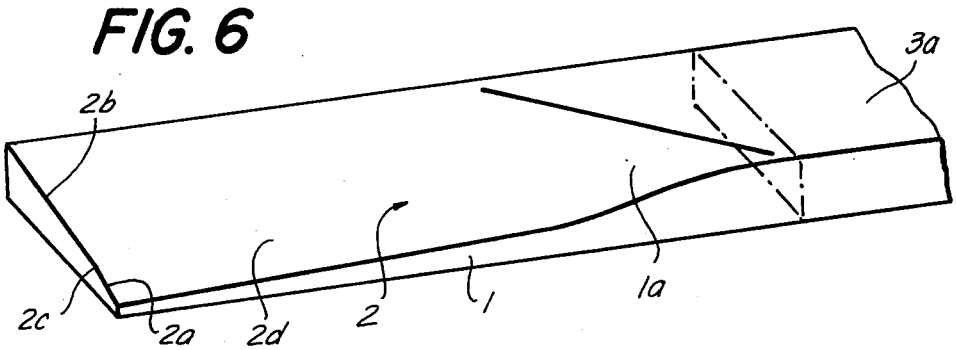
FIG. 6 is a further perspective view showing a modification of the ramp shown in FIG. 5.

Each of the ramps 1 which are arranged on the initial portion of the switch located upstream of the switch gap 5*b* as considered in the branching off direction (see FIG. 4), has two sections spaced from one another in the transverse direction and identified in FIG. 3 by reference numerals 2*a* and 2*b*. The section 2*a* is located adjacent to the longitudinal slot 5*a*, whereas the section 2*b* is transversely outwardly spaced from the slot 5*a* and terminates on the contact surface of the respective rail. The sections 2*a* and 2*b* have differing cross sections. The contact surface of the section 2*a* is inclined steeper than the contact surface of the section 2*b*. The more gently sloping section 2*b* can match to the wheel with only small deformation of the elastic wheel tires. The sections 2*a* and 2*b* are connected with one another by a transitional section 2*c* shaped as a circular arc. As shown in FIG. 5 it is possible to form the ramps 1 provided on the switch tip in a correspondent manner, in other words, to form each of these ramps 1 with the said sections 2*a* and 2*b* and the said transitional portion 2*c*. Respecting FIG. 6, a modificated type of ramps 1 also arranged on the switch tip each having a contact surface which is furthermore inclined in the direction of elongation of the respective rail as identified by reference numeral 2*d*.

In view of especially simple manufacture of the ramps 1 it is recommended to form them as separate members. Such separate members may be mounted on the members 3*a* which, in turn, are mounted on the bottom flanges 5. On the other hand, when the rails 3 are formed as projecting portions of the bottom flanges 5, the ramps may be mounted on the respective projecting portions of the bottom flanges 5. It is also possible that the respective regions of the members 3*a* or the bottom flanges 5 are shaped as the ramps 1.

It will be understood that each of the elements described above, or two or more together, may also find a useful application in other types of constructions differing from the types described above.

While the invention has been illustrated and described as embodied in a switch for a suspended vehicle having elastic wheels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A switch for a suspended railway vehicle having two elastic wheels, comprising a first, second, third and fourth rail, said first and second rails together forming a first double-rail path whereas said first rail with said third rail and said second rail with said fourth rail form second and third double-rail paths, respectively, which branch off from said first path, said four rails having contact surfaces and together bounding a gap so that during running of the vehicle on the switch from one to another path one wheel of the vehicle enters the gap and runs without support and after passing said gap the one wheel engages with a portion of one rail of the other path; a plurality of ramps each arranged on a respective one of said portions and having a contact surface provided with means for increasing surface contact of a wheel of the vehicle with each ramp, said surface contact increasing means including, on the contact surface of each ramp, a section which is inclined in a direction transverse to the direction of elongation of the respective rail so that when the one wheel after passing said gap runs onto a respective one of said ramps it is raised onto said contact surface of the one rail of the other path, said surface contact increasing means further including, on the contact surface of each ramp, a transitional portion merging into the respective rail with a transverse inclination which decreases proceeding in the direction along which the transitional portion merges into the respective rail.

2. A switch as defined in claim 1, particularly for a vehicle having a chassis and guiding rollers mounted thereon; and further comprising means for engaging the rollers of the chassis of the vehicle so as to support the latter on the switch in suspended condition.

3. A switch as defined in claim 1, particularly for a vehicle having a chassis, a casing and a suspension connecting the chassis with the casing, wherein each pair of rails forming a respective path has a slot therebetween arranged for passing the suspension of the vehicle therethrough.

4. A switch as defined in claim 3, wherein the slot between said pair of rails opens into said gap.

5. A switch for a suspended railway vehicle having two elastic wheels, comprising a first, second, third and fourth rail, said first and second rails together forming a first double-rail path whereas said first rail with said third rail and said second rail with said fourth rail form second and third double-rail paths, respectively, which branch off from said first path in a branching direction and merge into said first path in a merging direction, said four rails having contact surfaces and together bounding a gap so that during running of the vehicle on the switch from one to another path one wheel of the vehicle enters the gap and runs without support and after passing said gap the one wheel engages with a portion of one rail of the other path; a plurality of ramps each arranged on a respective one of said portions and having a contact surface which is inclined in the direction transverse to the direction of elongation of the respective rail so that when the one wheel after passing said gap runs onto a respective one of said ramps it is raised onto said contact surface of the one rail of the other path, the contact surface of each said ramps furthermore including a transitional portion merging into the respective rail with a transverse inclination which decreases proceeding in the direction along which the transitional portion merges into the respective rail, said plurality of ramps including two such ramps located downstream of said gap as considered in said merging direction, and each having two sections spaced from one another in said transverse direction, said sections of each of said two ramps having differing transverse inclinations.

6. A switch as defined in claim 5, wherein one of said sections is located adjacent to the gap between two respective rails whereas the other section is spaced from said gap and merges into a respective one of said two rails, said one section having a steeper transverse inclination than the other section.

7. A switch as defined in claim 6; and further comprising a transitional section connecting said first-mentioned sections with one another and being shaped as a circular arc.

8. A switch as defined in claim 1; wherein said second and said third path branch off from said first path in a branching direction and merge into said first path in a merging direction, said plurality of ramps including two such ramps located downstream of said gap as considered in said branching direction, and each having a contact surface which furthermore is inclined in the direction of elongation of the respective rail.

* * * * *